United States Patent [19]

Thorp

[11] 4,443,298

[45] Apr. 17, 1984

[54] CONTROLLED TURBULENCE HYDROFOIL BLADE SUPPORT MEMBER

[76] Inventor: Benjamin A. Thorp, 7 Ball Ct., Albany, N.Y. 12204

[21] Appl. No.: 355,315

[22] Filed: Mar. 8, 1982

[51] Int. Cl.[3] ..... D21F 1/54

[52] U.S. Cl. ..... 162/252; 162/352

[58] Field of Search ..... 162/252, 352, 374

[56] References Cited

U.S. PATENT DOCUMENTS

| | | | |
|---|---|---|---|
| 2,928,465 | 3/1960 | Wrist | 162/352 |
| 2,928,466 | 3/1960 | Burkhard et al. | 162/354 |
| 3,027,941 | 4/1962 | Dunlap | 162/352 |
| 3,432,385 | 3/1969 | Thorp | 162/352 |
| 3,515,636 | 6/1970 | Reynolds et al. | 162/352 |
| 3,535,201 | 10/1970 | Reynolds et al. | 162/352 |
| 3,576,715 | 4/1971 | Gedemer et al. | 162/352 |
| 3,578,561 | 5/1971 | McCarrick et al. | 162/352 |
| 3,711,368 | 1/1973 | Truxa | 162/352 X |
| 4,061,532 | 12/1977 | Biondetti | 162/352 |
| 4,321,108 | 3/1982 | Goddard et al. | 162/352 |

*Primary Examiner*—Richard V. Fisher

*Attorney, Agent, or Firm*—Witherspoon & Hargest

[57] ABSTRACT

A hydrofoil blade support member comprising a longitudinal extending hydrofoil body having a mounting element attached thereto. Hydrofoil blades are attached to the mounting element by a mounting device which allows the blades to extend in such longitudinal direction and further allows for spacing of such blades relative to each other in a variably selective dimension measured transverse to such longitudinal dimension. Spacing can be manual, semi-automatic or fully automatic.

13 Claims, 6 Drawing Figures

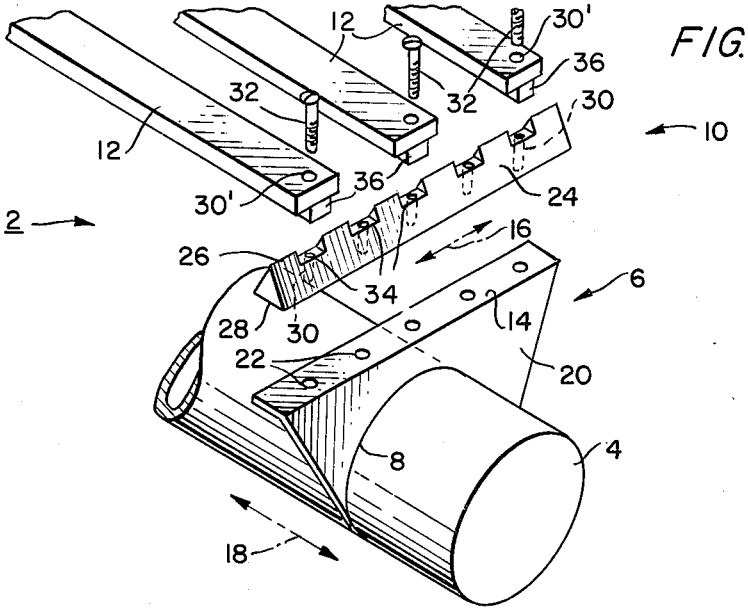
FIG. 1.
FIG. 2.
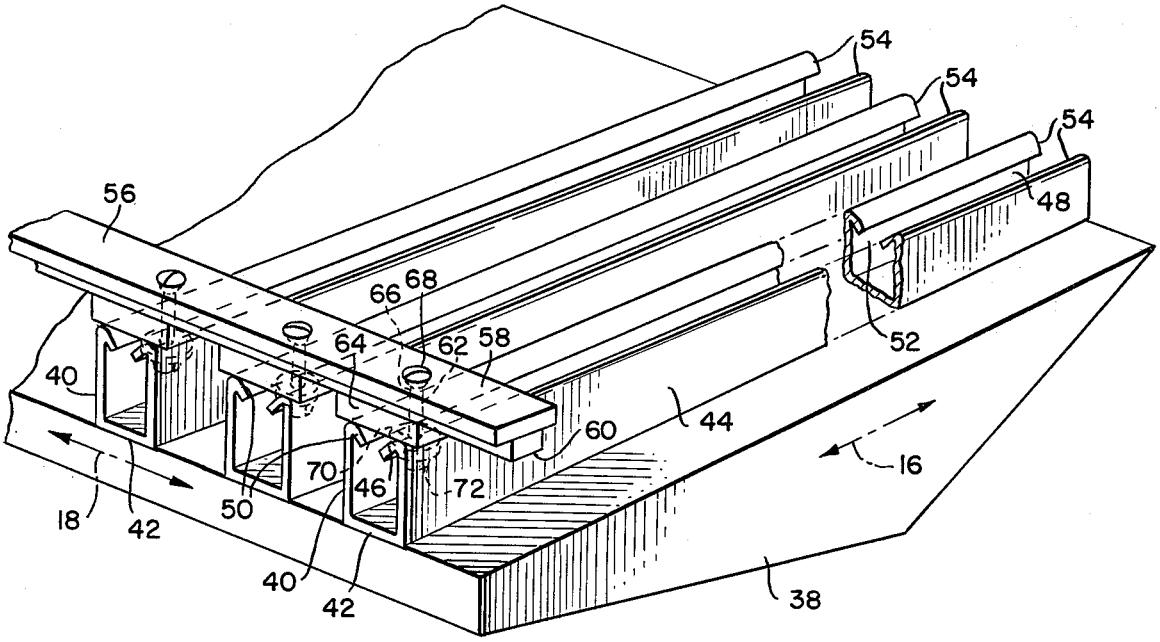
FIG. 1a.
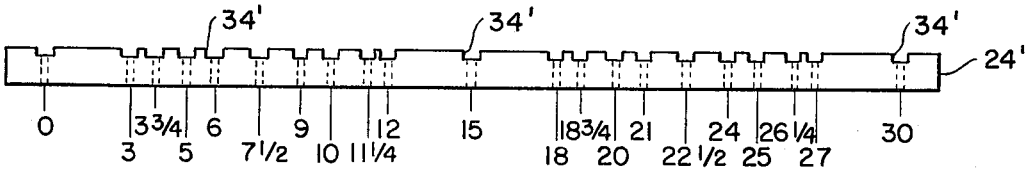

CONTROLLED TURBULENCE HYDROFOIL BLADE SUPPORT MEMBER

BACKGROUND OF THE INVENTION

In the typical foudrinier papermaking machine, an aqueous suspension of fibers, called the "furnish" is flowed onto a traveling fourdrinier wire or medium, generally a woven belt of wire and/or synthetic material, to form a continuous sheet of paper or paper-like material. In this connection, the expression "paper or paper-like material" is used in a broad or generic sense and is intended to include such items as paper, kraft, board, pulp, plastic, asbestos sheet and other nonwoven sheet-like structures. As the "furnish" travels along on the fourdrinier wire, much of its water content is removed by draining and a somewhat self-supporting continuous web is formed. This water removal is enhanced by the use of such well-known devices as hydrofoils, table rolls, and/or suction devices.

After leaving the forming section at the couch roll, the somewhat self-supporting web is transferred to a press section in the machine where still more of its water content is removed by passing it through a series of pressure nips formed by cooperating press rolls, these press rolls also serving to compact the web as well. The paper web is then transferred to a dryer section in the machine where it is passed about and held in heat transfer relationship with a series of heated, cylindrical rolls by which still further amounts of water are removed by evaporation. Finally, the paper web is passed through a series of calender rolls where loose fiber ends are laid down and the paper web is provided with a smooth finish, after which the paper web is collected on a suitable reel.

The present invention relates to a hydrofoil unit which comprises a hydrofoil blade support member and a plurality of spaced hydrofoil blades supported thereby. A hydrofoil blade is a stationary blade-like structure positioned beneath the forming medium in supporting relationship thereto. The functions of the hydrofoil blade include extracting water from the furnish to obtain a self-supporting web having the desired consistency and otherwise assuring proper formation of such web. The word "formation" is used herein to describe the interlocking of individual fibers to form networks or combinations of such individual fibers which are further matted together with other networks of fibers and collectively allow for the retention of various fines and fillers used in the papermaking process in producing the wet paper web. The present invention is directed to the function of paper web formation rather than dewatering per se and to this end is directed to controlling turbulence incurred in the forming section of the papermaking machine by providing a hydrofoil blade support member which allows for appropriate positioning of its associated hydrofoil blades.

In producing paper upon a fourdrinier papermaking machine the furnish is fed upon a moving forming medium which carries the paper web past various dewatering devices including hydrofoil units to remove water from the web. Such hydrofoil units include hydrofoil bodies which extend under the forming medium in the cross machine direction; that is, in a direction substantially at a right angle to the machine direction which is the direction in which the forming medium travels during the papermaking operation. Each hydrofoil body is generally supported upon support rails which extend in such machine direction along each side of the papermaking machine. Each hydrofoil body may support one or more hydrofoil blades and may be positioned along the support rails as desired allowing the user to be selective as to the area or areas to be dewatered during the papermaking process. In such hydrofoil units, although the hydrofoil body may be moved along the support rails, each hydrofoil blade is fixed relative to the hydrofoil body to which it is attached to the extent that each blade may not be moved in the machine direction relative to its supporting hydrofoil body or any other hydrofoil blades attached to such hydrofoil body, and in this connection reference is made to the following: Dunlap U.S. Pat. No. 3,027,941; Reynolds et al. U.S. Pat. Nos. 3,515,636 and 3,535,201; Gedemer et al. U.S. Pat. No. 3,576,715; Truxa U.S. Pat. No. 3,711,368; and, Boindetti U.S. Pat. No. 4,061,532. The dewatering capabilities of hydrofoil blades are well known in the art, and in this connection reference is made to Wrist U.S. Pat. No. 2,928,465, Burkhard et al. U.S. Pat. No. 2,928,466 and Thorp U.S. Pat. No. 3,432,385.

As the furnish is carried past the hydrofoil blades the furnish is continually in motion as a result of the movement of the forming medium and the forces exerted upon the furnish by the blades. Such motion is turbulent in that the individual particles of the furnish and/or the groupings of a plurality of such particles which have come together to form networks are moving in a highly irregular and rapidly fluctuating manner. During this phase of the papermaking process such continued agitation of the furnish has a significant affect upon the characteristics of the web being formed. Although it is believed that some turbulent motion is necessary to properly deflocculate the constituent fibers which comprise the furnish, it would be desirable to be able to control the degree of such motion in order to eliminate any deleterious characteristics which may result from too much or too little turbulent activity. In controlling turbulence it would be desirable to be able to control the intensity or force of the turbulence, its scale or size as well as the rate of decay or diminution thereof and to selectively control the rate or frequency of phase change of machine direction oriented furnish ridges. It is believed that such control of turbulence will significantly add to the control of flocculation of the fibers which form the furnish and thereby significantly affect the ability to control the nature of the paper web produced during the critical formative stages as the furnish travels through the forming section of the papermaking machine.

Accordingly, it is an object of this invention to provide a means whereby turbulence of the furnish in the forming section of the papermaking machine may be controlled.

Another object of this invention is to provide a means whereby turbulence of the furnish may be selectively controlled during the papermaking operation.

Yet another object of this invention is to provide a means to deflocculate as desired the constituent fibers which comprise the furnish.

Still another object of this invention is to provide a means whereby the appropriate utilization of hydrofoil units may be effected to assure that the furnish is not subjected to too much or too little turbulent activity as the wet paper web is carried upon the forming medium past hydrofoil blades.

A further object of this invention is to provide a means whereby turbulence of the furnish in the forming section of the papermaking machine may be controlled by selectively controlling the rate of frequency of phase change of machine direction oriented furnish ridges.

SUMMARY OF THE INVENTION

This invention achieves these and other objects by providing a hydrofoil blade support member comprising a longitudinally extending hydrofoil body and a mounting element having at least one first surface for attaching such mounting element to the hydrofoil body. Means are associated with the mounting element for attaching elongated hydrofoil blades to a second surface of such mounting element such that the blades extend in the longitudinal dimension and are spaced relative to each other in a variably selective dimension measured transverse to such longitudinal dimension. Movement of the blades may be manual, semi-automatic or fully automatic.

BRIEF DESCRIPTION OF THE DRAWINGS

This invention may be clearly understood by reference to the attached drawings in which:

FIG. 1 is an exploded partial view of one embodiment of the present invention;

FIG. 1*a* is a view of another embodiment of the present invention;

FIG. 2 is a partial view of another embodiment of the present invention;

DESCRIPTION OF THE PREFERRED EMBODIMENT

Figure 3:
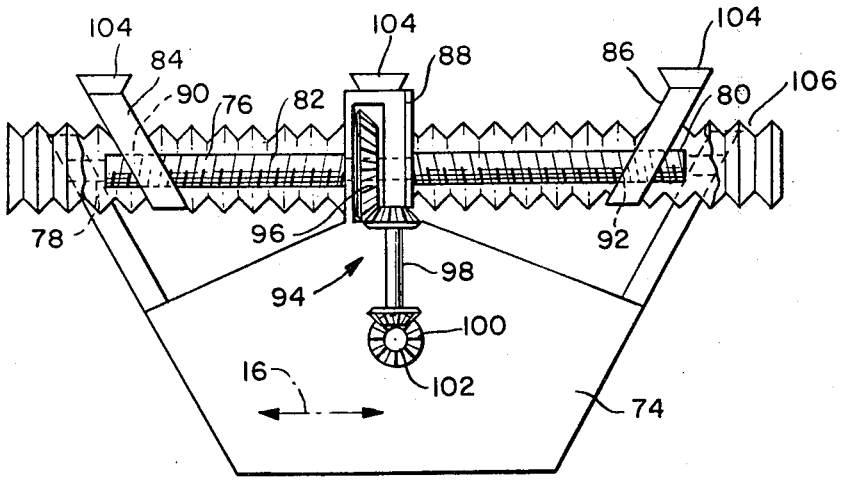
FIG. 3 is a view of a further embodiment of the present invention.

The embodiment of this invention which is illustrated in FIG. 1 is one which is particularly suited for achieving the objects of this invention. FIG. 1 depicts a hydrofoil blade support member 2 of the present invention. Support member 2 includes a cylindrical hydrofoil body 4 which is generally circular in cross section and extends longitudinally in the direction of the axis of the cylinder. The particular configuration of the hydrofoil body is by way of example only, it being understood that other hydrofoil bodies may be used. For example, other hydrofoil bodies known in the art include, without limitation, triangular, pentagonal, quadrilateral and truss type structures. A mounting element 6 is provided which includes at least one first surface 8 which is attached to the hydrofoil body 4. Means generally designated 10 are associated with mounting element 6 for attaching the elongated hydrofoil blade (not shown) to a second surface 14 of the mounting element 6 such that the blades extend in the longitudinal dimension and are spaced relative to each other in a variably selective dimension measured transverse to the longitudinal dimension. The transverse and longitudinal dimensions are identified by the arrows designated 16 and 18, respectively.

In the preferred embodiment the mounting element 6 includes a transversely extending bulkhead 20 having a surface portion which forms the second surface 14. Second surface 14 comprises at least one opening 22 therein. Preferably there are a plurality of such openings 22 as depicted in FIG. 1.

Attaching means 10 may comprise a mounting device 24 and mean for attaching a hydrofoil blade to mounting device 24. Although not necessary, mounting device 24 is depicted as being triangular in cross section. Such a configuration will assist in containing splashback and other contamination during the papermaking process. Mounting device 24 includes a second surface 28 for attaching device 24 to bulkhead 20. The means for attaching hydrofoil blade to mounting device 24 may include a detachable mounting member 12 which is depicted as a T-bar type hydrofoil blade support attached to a first surface 26 of mounting device 24. In order to be able to space detachable mounting members 12 in a predetermined selective transverse dimension, the second surface 14 of bulkhead 20 comprises at least one opening 22 therein, the second surface 28 of mounting device 24 comprises at least one opening 30 therein and the mounting member 12 comprises an opening 30′ therein. Wherever a member 12 is to be mounted, openings 22, 30 and 30′ are in alignment or register with one another so that the mounting member may be selectively affixed to the mounting device and bulkhead by providing means which extend through the openings 22, 30 and 30′. In the preferred embodiment the affixing means includes an elongated member 32 which extends through the openings 22, 30 and 30′ wherever a member 12 is provided. Elongated member 32 is depicted in FIG. 1 as a bolt although it will be apparent to those skilled in the art that other elongated members may be used.

As noted above, mounting device 24 includes a first surface 26 having means for attaching mounting members 12 to the mounting device. Hydrofoil blades (not shown) may be mounted upon each mounting member 12 in a known manner. Surface 26 may have a portion thereof cut out in a predetermined configuration which conforms or mates with a portion of the mounting member 12 to be attached to the mounting device. By way of example and without limitation, FIG. 1 depicts surface 26 including cut out portions 34 which mate with the extended portion 36 of member 12. Of course, when positioned in the forming section of a papermaking machine, hydrofoil body 4 will extend beneath the forming medium from one side of the machine to the other in the cross-machine direction. A bulkhead 20 and mounting device 24 will be attached to body 4 at least at either end thereof to support mounting member 12 at each of its ends, and preferably additional bulkheads and mounting devices will be attached to body 4 to provide additional support to mounting members 12 throughout their expanse across the machine width. A member 12 may be mounted or attached to mounting devices 24 by fitting extended portion 36 into cut out portion 34. It will be apparent that the transverse spacing between cut out portions 34 and the number of mounting members 12 and associated hydrofoil blades being used determine the transverse spacing between such hydrofoil blades. For example, in the embodiment depicted in FIG. 1, transverse spacing between blades may be selectively varied as desired by inserting a mounting member 12 into two, three, four or five cut out portions 34. For example, as shown in FIG. 1, members 12 have been inserted into every other cut out portion 34 to provide a total of three blades having a predetermined transverse spacing. Such spacing may be varied by removing the middle member 12 or by inserting an additional member 12 into the two remaining unoccupied cut out portions 34. Without limitation, by providing the mounting device 24' of FIG. 1*a*, the twenty one cut out portions 34' will provide a full range of practical mounting members and associated blade spacing for existing papermaking machines. Such range includes the following mounting member and blade spacing for the designated number of mounting members and blades.

| Number of Blades | Spacing (Inches) |
|---|---|
| 2 | 30 |
| 3 | 15 |
| 4 | 10 |
| 5 | 7½ |
| 6 | 6 |
| 7 | 5 |
| 9 | 3¾ |
| 11 | 3 |

In this manner means are provided for attaching elongated hydrofoil blades to a mounting element such that the blades extend in the longitudinal dimension and are spaced relative to each other in a variably selective transverse dimension.

Alternatively, in the embodiment of FIG. 1 transverse spacing between blades may be selectively varied as desired by removing mounting device 24 having a first predetermined transverse spacing of cut out portions 34 as shown and replacing it with another mounting device having a different predetermined transverse spacing at such cut out portions. A similar result may be obtained by providing a removeable mounting device 24 for each blade, spacing between blades being selectively varied by adding or removing such individual mounting devices as desired. In such alternative embodiments means are also provided for attaching elongated hydrofoil blades to a mounting element such that the blades extend in the longitudinal dimension and are spaced relative to each other in a variably selective transverse dimension.

Figure 5:
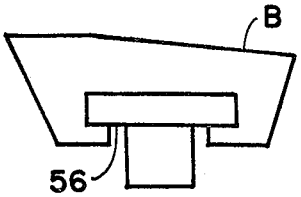
FIG. 5 is an end view of a prior art hydrofoil blade B mounted upon a mounting device for use in the present invention.

In another embodiment of the present invention a hydrofoil body 38 as depicted in FIG. 2, is provided including a bulkhead 40 having a first surface 42 attached to body 38. Bulkhead 40 includes a first transversely extending wall 44 having a first transversely extending flanged portion 46 and a second transversely extending wall 48 having a second transversely extending flanged portion 50. First flanged portion 46 is spaced from second flanged portion 50 to form an opening 52 in a second surface 54 of bulkhead 40. In the embodiment of FIG. 2, the means for attaching the hydrofoil blade (not shown) to the bulkhead includes a mounting device 56. A prior art hydrofoil blade B is shown attached to mounting device 56 in FIG. 5. Mounting device 56 is depicted as a T-bar supporting member although any other appropriate hydrofoil blade support may be used. Mounting device 56 includes a first surface 58 for attaching a hydrofoil blade to the mounting device for spacing the hydrofoil blades in a predetermined selective transverse dimension. Mounting device 56 also includes a second surface 60 for moveably attaching device 56 to bulkhead 40. For this purpose opening 62 is provided. Means extend through openings 52 and 62 to slideably affix the mounting device 56 to the bulkhead 40. Mounting pads 64 may be provided between mounting device 56 and bulkhead 40, if desired. In the embodiment depicted in FIG. 2, the affixing means includes an elongated member 66 which extends through openings 52 and 62. Elongated member 66 is depicted as a bolt one end 68 of which bears against mounting device 56 and the other end of which comprises a washer 70 and nut 72 which bear against the flanged portions 46 and 50 to moveably affix the mounting device 56 to bulkhead 40.

In operation, the hydrofoil body 38 may extend beneath the forming medium from one side of the papermaking machine to the other in the cross-machine direction. Bulkheads 40 are attached to body 38 in sufficient quantity to support each mounting device 56 throughout its expanse across the machine width. A blade may be mounted or attached to devices 56 by using a blade having a T-shaped cut out portion for mounting purposes and sliding such blade upon the device 56 so that the blade T-shaped cut out portion mates with the T-bar mount. The transverse spacing between T-bar mounts determines the transverse spacing between hydrofoil blades. In the embodiment of FIG. 2, transverse spacing between blades may be selectively varied as desired by loosening nuts 72 and sliding the mounting device 56 along surface 54 until device 56 is properly positioned. Subsequent tightening of nuts 72 holds the device in place. In this manner means are provided for attaching elongated hydrofoil blades to a mounting element such that the blades extend in the longitudinal dimension and are spaced relative to each other in a variably selected transverse dimension.

The embodiment depicted in FIG. 3 is one which allows for selectively varying machine direction spacing of hydrofoil blades while the forming medium is in motion during the papermaking process. FIG. 3 depicts a hydrofoil blade support member comprising a hydrofoil body 74 including a mounting element 76 having first surfaces 78, 80 attaching the element 76 to the body 74. Attaching means are provided for attaching hydrofoil blades (not shown) to a second surface 82 of the mounting element such that the blades extend in a longitudinal dimension and are spaced relative to each other in a variably selective transverse dimension. In FIG. 3 the attaching means include a plurality of mounting devices at least one of which is moveably attached to the mounting element for transverse movement relative to at least one other mounting device. For example, FIG. 3 depicts mounting devices 84 and 86 as being moveably attached to mounting element 76 for transverse movement relative to each other. Although not necessary, in the preferred embodiment a stationary mounting device 88 may also be provided. In FIG. 3, mounting element 76 is depicted as comprising an elongated threaded screw extending in the transverse direction. The ends of the screw form first surfaces 78, 80 for attachment of the mounting element to hydrofoil body 74. The elongated screw is depicted as including threaded portions which form the second surface 82 to which the mounting devices are attached. One length of the screw is depicted as including right handed threads and the second length of the screw is depicted as including left handed threads. Mounting devices 84 and 86 include internal threads 90 and 92 which mesh with the right and left handed threads. Means generally designated 94 are provided for rotating screw 76 to cause relative transverse movement of at least one mounting device and one other mounting device. For example, as depicted in FIG. 3, rotation of screw 76 will cause transverse movement of mounting devices 84 and 86 relative to each other and stationary mounting device 88. Rotation means 94 may include any known means to cause screw 76 to rotate. By way of example, rotating means 94 may include a first gear 96 attached to screw 76 and meshing with a second gear system 98 which meshes with a third gear 100 attached to shaft 102. To avoid contamination, screw 76 may be covered with an expansible, compressible member 106. Without limitation, such member may comprise a flexible hose and the like.

In operation, the hydrofoil body 74 may extend beneath the forming medium from one side of the papermaking machine to the other in the cross-machine direction. Mounting elements 76 and mounting devices 84, 86 and 88 are attached to body 74 in sufficient quantity to support each hydrofoil blade throughout its expanse across the machine width. Blades may be mounted or attached to devices 84, 86 and 88 by using blades having a dove-tail shaped cut out portion for mounting purposes and sliding such blades upon devices 84, 86 and 88 so that the blade dove-tail shaped cut out portion mates with the dove-tail mounts 104 of the mounting devices 84, 86 and 88. The transverse spacing between dove-tail mounts determines the transverse spacing between hydrofoil blades. In the embodiment of FIG. 3, transverse spacing between blades may be selectively varied as desired by causing shaft 102 and gear 100 to rotate thereby causing the gears of gear system 98 to rotate. The rotation of the gears of gear system 98 causes gear 96 and screw 76 to rotate thereby causing the relative transverse movement of the mounting device described above. Rotation of shaft 102 may be caused by any known manner including without limitation a hand crank or motor (not shown). In this manner means are provided for attaching elongated hydrofoil blades to a mounting element such that the blades extend in the longitudinal dimension and are spaced relative to each other in a variably selected transverse dimension. It should be noted that although FIG. 3 depicts two moveable mounting devices, one stationary mounting device, and one driving mechanism it will be apparent to those skilled in the art that more or less mounting devices and driving mechanisms may be provided.

Figure 4:
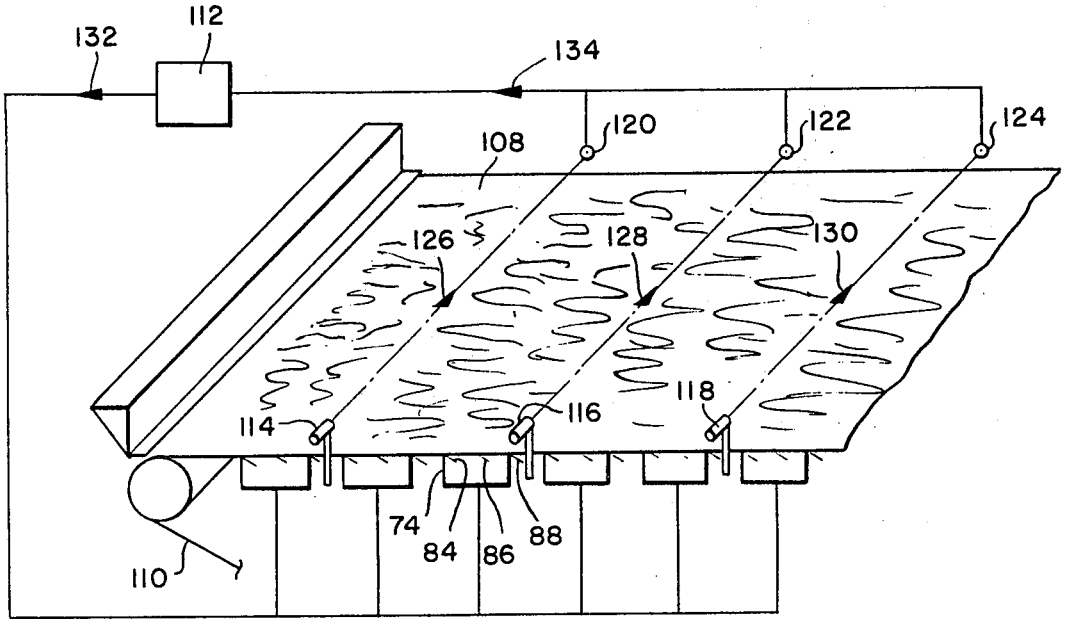
FIG. 4 is a diagramatic representation of yet another embodiment of the present invention.

In one embodiment of the invention means are provided for selectively automatically causing movement of the mounting devices in response to the detection of predetermined conditions. For example, FIG. 4 is a partial view of the forming section of a papermaking machine including a headbox which deposits furnish 108 upon the traveling forming medium 110. Although the details of the hydrofoil blade support member of FIG. 3 are not depicted in FIG. 4, for purposes of this description it is assumed that each hydrofoil blade support member depicted in FIG. 4 includes all of the structure depicted and described regarding FIG. 3. For example, FIG. 4 depicts a plurality of hydrofoil blade support members comprising hydrofoil bodies 74 and hydrofoil blades attached to mounting devices 84, 86 and 88. Also provided is a control mechanism 112 which is any type known in the art to be useful in receiving input signals and sending output or command signals in response thereto. A plurality of light emitting units 114, 116 and 118 and corresponding light receiving units 120, 122 and 124 are provided. Emitting units 114, 116 and 118 project beams of light 126, 128 and 130 to their corresponding receiving units 120, 122 and 124. The units are positioned so that the beams of light pass through the furnish so that changes in the turbulence of that portion of the furnish passing through such beams will affect the intensity of the light being received at receiving units 120, 122 and 124. For example, if turbulence of the furnish increases in the vicinity of the path of a beam, then the amount of furnish interfering with the passage of light at such beam will increase to decrease the light intensity received at the respective receiving unit. Similarly, if turbulence of the furnish decreases in the vicinity of the path of a beam, then the amount of furnish interfering with the passage of light at such beam will decrease to increase the light intensity received at the respective receiving unit. By calibrating light intensity with the turbulence of furnish the computer controller 112 can be programmed to send appropriate signals 132 to motors (not shown) to cause such motors to rotate axle 102 to cause transverse movement of mounting devices 84 and 86 as described above either towards or away from each other. It will be apparent to those skilled in the art that the direction of such transverse movement will depend upon whether the motors cause axles 102 to rotate in a clockwise or counterclockwise direction. That is to say, computer controller 112 may be programmed to send signals 132 which energize motors (not shown) to rotate axle 102 in one direction to decrease spacing between the mounting devices when turbulence drops below a predetermined level or range. In this case the sending of output signals 132 may be in response to the receiving by computer controller 112 of input signals 134 which indicate a decrease in turbulence and corresponding increase in light intensity at the receiving units. At the same time, computer controller 112 may be programmed to send signals 132 which energize motors (not shown) to rotate axle 102 in an opposite direction to increase spacing between the mounting devices when turbulence rises above a predetermined level or range. In this case the sending of output signals 132 may be in response to the receiving by computer controller 112 of input signals 134 which indicate an increase in turbulence and corresponding decrease in light intensity at the receiving units. In this manner means are provided for attaching hydrofoil blades to a mounting element such that the blades extend in the longitudinal dimension and are spaced relative to each other in an automatically variable selected transverse dimension.

Reference is made throughout this patent application to a hydrofoil unit which is positioned in the forming section of a papermaking machine and comprises a hydrofoil blade support member which comprises a hydrofoil body, a mounting element attached thereto and means associated with the mounting element for attaching hydrofoil blades to the mounting element. It should be understood that in addition to such hydrofoil units the present invention relates to other forming and dewatering units such as those which include a blade support member as described herein and blades, other than hydrofoil blades, of the type known in the art associated therewith for use in a forming box, forming board, forming shoe, dewatering box and dewatering shoe. Accordingly, throughout this specification and claims attached hereto any reference to hydrofoil blade support member is meant to include a blade support member of such forming and dewatering units, and any reference to hydrofoil body or hydrofoil blade is meant to include bodies and blades, respectively, of the type for use in such forming and dewatering units. As such the specification and claims also relate to blade support members for use in a forming box, forming board, forming shoe, dewatering box and dewatering shoe which comprises a longitudinally extending body, a mounting element attached to said body and means associated with said mounting element for attaching such blades to said mounting element.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A blade support member for use in a papermaking machine, and blades supported by said support member, wherein said member is positionable upon existing support structure in a forming section of said machine beneath a moveable forming medium, comprising:

a body extendable beneath said forming medium in a longitudinal direction from one side of said papermaking machine to the other for attachment of said support member to existing papermaking machine support structure;

at least two mounting elements attached to said body and extending in a direction transverse to said longitudinal direction and for a short length relative to the overall length of said papermaking machine forming section, one of said mounting elements being attached to said body at said one side and the other of said mounting elements being attached to said body at said other side; and, means attached to said mounting elements and supporting a plurality of blades, each of said blades extending in said longitudinal direction such that at least one of said blades is moveable in said transverse direction relative to at least one other of said blades and relative to said mounting elements.

2. The blade support member of claim 1 wherein said supporting means comprises a plurality of mounting devices attached to said mounting elements and extending in said longitudinal direction, each of said mounting devices supporting one of said blades, at least one of said mounting devices being moveable in said transverse direction relative to at least one other of said mounting devices and relative to said mounting elements.

3. The blade support member of claim 2 wherein each mounting element includes a transversely extending bulkhead.

4. The blade support member of claim 3 wherein each mounting device has a first surface including means for attaching one blade to said mounting device for said movement in said transverse direction, and a second surface for attaching said mounting device to said bulkheads.

5. The blade support member of claim 4 wherein each bulkhead includes at least one first surface for attaching said bulkhead to said body, and a second surface which comprises at least one opening therein, wherein said mounting device second surface comprises at least two openings therein each of which registers with a bulkhead opening, and wherein means extend through said registered openings to affix said mounting device to said bulkhead.

6. The blade support member of claim 5 wherein said affixing means includes an elongated member which extends through said registered openings.

7. The blade support member of claim 6 wherein said second surface of each bulkhead includes a first transversely extending wall having a first transversely extending flanged portion and a second transversely extending wall having a second transversely extending flanged portion, said first flanged portion being spaced from said second flanged portion to form said opening in said bulkhead second surface.

8. The blade support member of claim 7 wherein one end of said elongated member bears against said mounting device and the other end of said elongated member includes means attached thereto which bears against said flanged portions to moveably affix said mounting device to said bulkhead.

9. The blade support member of claim 4 wherein said means for attaching said one blade to said mounting device includes a detachable mounting member.

10. The blade support member of claim 9 wherein each of said detachable mounting members is a T-bar type hydrofoil blade support.

11. The blade support member of claim 2 wherein each mounting element comprises at least one elongated threaded screw extending in the transverse direction, the ends of said screw forming first surfaces for attachment to said body, said screw including threaded portions forming a second surface, a first length of said screw including right handed threads and a second length of said screw including left handed threads, at least one of said mounting devices including internal threads which mesh with said right handed threads and at least one other of said mounting devices including internal threads which mesh with said left handed threads, and means for rotating said screw to cause said transverse movement.

12. The blade support member of claim 11 further including another mounting device which is stationary relative to said moveable mounting devices.

13. The blade support member of claim 2 further including means for selectively automatically causing movement of said moveable mounting devices in response to the detection of predetermined conditions.

* * * * *